US008588033B2

(12) United States Patent
Pozzo Di Borgo et al.

(10) Patent No.: US 8,588,033 B2
(45) Date of Patent: Nov. 19, 2013

(54) WRISTWATCH WITH ELECTRONIC DISPLAY

(71) Applicant: Comme Le Temps SA, Saint-Prex (CH)

(72) Inventors: Pascal Pozzo Di Borgo, Montreux (CH); Jorg Hysek, Monaco (MC)

(73) Assignee: Comme le Temps SA, St-Prex (CH)

( * ) Notice: Subject to any disclaimer, the term of this patent is extended or adjusted under 35 U.S.C. 154(b) by 0 days.

(21) Appl. No.: 13/631,116

(22) Filed: Sep. 28, 2012

(65) Prior Publication Data

US 2013/0142016 A1 Jun. 6, 2013

Related U.S. Application Data

(63) Continuation of application No. PCT/EP2011/054873, filed on Mar. 30, 2011.

(30) Foreign Application Priority Data

Mar. 30, 2010 (CH) ..... 463/10

(51) Int. Cl.

| | |
|---|---|
| ***G04G 9/00*** | (2006.01) |
| ***G04G 9/02*** | (2006.01) |
| ***G04G 21/08*** | (2010.01) |
| ***G04G 3/00*** | (2006.01) |

(52) U.S. Cl.
USPC ..... 368/82; 368/223; 368/239; 368/69; 345/173; 715/863

(58) Field of Classification Search
USPC ..... 368/82, 239, 223, 69
See application file for complete search history.

(56) References Cited

U.S. PATENT DOCUMENTS

| | | | | |
|---|---|---|---|---|
| 6,097,390 | A * | 8/2000 | Marks | 715/772 |
| 6,308,061 | B1 * | 10/2001 | Criss et al. | 455/418 |
| 6,601,988 | B2 * | 8/2003 | Molander | 368/187 |
| 6,714,486 | B2 * | 3/2004 | Biggs | 368/82 |
| 7,274,375 | B1 * | 9/2007 | David | 345/619 |
| 7,751,285 | B1 * | 7/2010 | Cain | 368/82 |
| 7,859,947 | B2 * | 12/2010 | Kawai | 368/10 |
| 2001/0055244 | A1 * | 12/2001 | Kim | 368/73 |
| 2003/0214885 | A1 | 11/2003 | Powell et al. | |
| 2005/0278757 | A1 | 12/2005 | Grossman et al. | |
| 2008/0186808 | A1 * | 8/2008 | Lee | 368/10 |
| 2012/0092383 | A1 * | 4/2012 | Hysek et al. | 345/684 |

FOREIGN PATENT DOCUMENTS

| | | | |
|---|---|---|---|
| GB | 2425370 | A | 10/2006 |
| WO | WO-2006111481 | A2 | 10/2006 |
| WO | WO-2011/000893 | A1 | 1/2011 |

OTHER PUBLICATIONS

Mechanical Software 3D Screensaver, CNET, Apr. 28, 2011, 2 pages URL:http://download.cnet.com/Mechanical-Clock-3D-Screensaver/3000-2257_4-10575385.html.

* cited by examiner

*Primary Examiner* — Amy Cohen Johnson
*Assistant Examiner* — Matthew Powell
(74) *Attorney, Agent, or Firm* — Blank Rome LLP

(57) ABSTRACT

Method for displaying the time in a wristwatch furnished with an electronic display (4) allowing the display of a simulated mechanical watch movement and of time indicators (20) so as to simulate a mechanical watch. The time displayed is advantageously calculated on the basis of the simulation of the movement and depends on the acceleration measured by an accelerometer.

19 Claims, 4 Drawing Sheets

WRISTWATCH WITH ELECTRONIC DISPLAY

RELATED APPLICATIONS

The present invention is a continuation of International Application PCT/EP2011/054873, filed on Mar. 30, 2011, the contents of which is herewith enclosed by reference. It claims priority from Swiss Patent Application CH2010/0463, filed on Mar. 30, 2010, the contents of which is herewith enclosed by reference.

TECHNICAL FIELD

The present invention pertains to a wristwatch, in particular an electronic wristwatch having a high-resolution display screen.

STATE OF THE ART

Wristwatches can be classified into two main families depending on the type of movement used. Electronic watches, most often regulated by a quartz crystal, have the advantage of great accuracy and moderate cost thanks to industrial manufacturing technology. The time calculated by electronic watches is most often displayed in digital fashion on a liquid crystal segment display or sometimes by means of hands driven by a stepping motor whose running is regulated by the quartz. Liquid crystal segment displays have the disadvantage of a limited contrast making it uncomfortable to read the digital symbols formed by the segments, notably in low ambient light. Stepping motors generally cause a jerky displacement of the hands, considered unquiet and not representative of the continuous passing of time.

Mechanical movements make it possible to display the time by means of hands or other indicators moving in near-continuous manner whilst making the reading comfortable, even when the ambient light is low. Furthermore, the extraordinary ingenuity of some mechanical movements and the possibility of showcasing their components is considered fascinating by many users, notably in the case of skeleton watches that enable parts of the movement to be admired through the watch crystal and the dial. Mechanical watches thus generate considerable interest and there is an established commercial need for mechanical watches with a dial animated by the elements of the movement in motion.

The manufacture of mechanical movements, however, is complex, so that mechanical movements are generally more expensive than electronic movements. This is in particular the case of mechanical movements with grand complications or when the movement needs to be decorated or machined so as to be permanently visible behind the watch crystal. Mechanical watches displaying their complications are thus almost exclusively reserved to the upper segment of the luxury watch market. Furthermore, only a small proportion of the potentially interested customers can avail of the mechanical watch collection that is required in order to appreciate the multitude of different complications proposed by the watchmakers.

Furthermore, the accuracy of mechanical movements is generally lower than that of electronic movements of comparable price. This will result in a number of customers, who expect a luxury watch to have a high precision, being disappointed.

GB2425370 describes a grandfather clock having a video screen for displaying a film shown in a loop with performances by human subjects. This solution is not adapted to a wristwatch. US20050278757 describes a system for downloading watch faces displayed on a device. US20030214885 describes a watch whose dial is replaced by a screen enabling the time to be represented in different ways. None of these prior art solutions makes it possible to display the watch movement. These solutions do not provide the fascination of fine mechanical watches and are intended for devotees of electronic watches.

There has thus for a long time been a need for a watch that allows these problems in the prior art to be solved and that satisfies the partly contradictory expectations of the market.

In particular, there is a need for a watch enabling its user to admire the operation of the mechanical movement whilst providing the accuracy and price comparable to those of a quartz watch.

There is also a need for a complication watch that is more economical than ordinary mechanical watches.

There is furthermore also a need for a watch enabling the visualized movement to be easily replaced in order to admire for example different types of mechanical complications.

There is also a need for a wristwatch enabling a large number of different indications to be displayed, yet without cluttering up the display.

There is also a need for a wristwatch enabling the type of displayed information, as well as the manner in which this information is presented, to be customized.

BRIEF SUMMARY OF THE INVENTION

One aim of the present invention is to propose a wristwatch combining the advantages of watches with mechanical movements with those of electronic watches.

According to the invention, these aims are achieved and these needs fulfilled notably by means of a wristwatch comprising a watchcase, a microcontroller, an electronic display in the watchcase, a simulated mechanical watch movement displayed on said electronic display and visible within the watchcase, arranged in order to indicate the time.

This watch thus makes it possible to display a simulated mechanical movement that is as complex as desired whilst avoiding the manufacturing costs of a real, physical and tangible mechanical movement. Furthermore, the precision of this watch can be as high as that of an electronic watch whilst providing the animations of a high-end mechanical watch.

The invention is based notably on the observation that modern electronic displays demonstrate sufficient realism for displaying a credible simulation of a complex mechanical movement; the required resolution would have been impossible to achieve some years ago or would have required a power-consumption incompatible with integration into a wristwatch.

The invention is also based on the observation that the computational power of the current watch microcontrollers (i.e. of microcontrollers of a size and with a power consumption compatible with a watchmaking application) enables a realistic simulation of a complex mechanical movement to be calculated and displayed in real time.

The simulated mechanical movement is advantageously displayed over the entire surface of the electronic display, which is assembled end-to-end against the inner surface of the flange or of the bezel. In this manner, the simulated mechanical movement occupies the position and the dimensions of a real mechanical movement. Indicator elements, for example hands, discs, cylinders etc., can be shown on the display. Control means enable the display to be modified and a mechanical movement to be selected from among several available movements. It is also possible to display a simulated dial or a real dial covering totally or partly the simulated mechanical movement.

In a preferred embodiment, the display is a display associated with a touch sensor, for example a display associated with a multi-touch or single-touch touch-sensor. This enables the realism of the representation to be increased; the user can for example influence the position or the displacement of a component of the movement by pressing or moving the representation of that component. For example, it is possible to make a simulated virtual movement in which the user can turn or stop the hands or certain gears or other elements by pressing on their representation or by moving this representation with a trajectory of the finger on the screen.

In one embodiment, the watch comprises a crown on the outside of the watchcase and a representation of the virtual and simulated crown stem displayed on the screen opposite this crown. The position of the crown stem is modified by the watch's microcontroller when this microcontroller detects that the crown has been actuated, so as to simulate a direct action by the crown on the simulated crown stem. This crown can also be used for setting the time or winding up the simulated mechanical movement; this movement can for example stop after a certain time if it is not rewound by the physical crown.

In a similar manner, the action of the physical push-buttons on the movement can be simulated by displaying a simulated element opposite the push-button, whose position is modified in case the push-button is actuated, so as to simulate a direct action by said push-button on said simulated element.

In a preferred embodiment, the wristwatch further comprises an accelerometer used for example to increase the realism of the representation by making it dependent on the accelerations to which the watch is subjected. For example, the position of at least one element of the movement depends on an output signal from the accelerometer. It is thus possible to simulate the displacement of an oscillating mass for winding up the simulated movement depending on the watch, to visualize the deformations of the spiral or the displacements of a tourbillon or of the balance depending on gravity, or to show the oscillations of the gear-train or of other components when the watch is shaken.

In order to make the effect of these accelerations realistic, at least some elements of the movement have a virtual mass used for the simulation. The microcontroller thus calculates the forces and the displacement to which these elements are subjected according to the measured acceleration, for example gravity or a shock, and displays these displacements or deformations. At least some elements, for example the springs or the spiral, can also have a virtual rigidity and can deform according to the measured accelerations or to the displacements of other components of the simulated movement. The acceleration can for example be measured along 3 axes. It is also possible to measure rotations along one or several axes by means of a gyroscope.

In one embodiment, the running of the movement depends on the measured accelerations. For example, it is possible to take into account the effect of gravity and of shocks on the regulating organ to affect the running of this regulating organ or the position of a tourbillon. A simulated barrel can unwind if the accelerometer detects no acceleration to displace the oscillating mass and the mechanical movement can slow down and then stop when unwound.

The time displayed by the displayed movement thus preferably depends on the results of the simulation, taking into account the rigidity of the parts or the accelerations measured. In one advantageous embodiment, the time of the simulated movement can be synchronized with the time determined by the quartz movement, in order to reset the simulated mechanical movement. This synchronization can be performed automatically, for example periodically, or in case of variations exceeding a predetermined threshold, and/or at the user's request through an appropriate command.

One advantage of the present solution is that it enables mechanical movements to be simulated and displayed that would be impossible or very expensive to manufacture in practice. For example, it is possible to display virtual mechanical movements simulated with a regulating organ oscillating at a frequency considerably higher than in a classic movement and with elements that turn much faster, producing a more interesting animation. It is also possible to simulate oscillating masses or balances with a very high density, and other moving parts with a density that is on the contrary much lower than that afforded by ordinary materials. Furthermore, it is possible to simulate parts with very low or even zero friction coefficients and with very great or even infinite rigidity and solidity. Finally, it is possible to simulate barrel or spiral springs with return constraints considerably greater than in the prior art. In one advantageous embodiment, the simulation is however always a "realistic" simulation, calculated taking into account correct physical laws even if it is based on the properties of non-existing materials.

In one advantageous embodiment, the display does not reproduce a simple animated image or a previously recorded video displayed in a loop, but a calculated simulation of the position of the displayed elements taking into account for example the simulated shape and mass of these elements and of the environment (for example of the buttons, of the acceleration etc.). Each successive image is thus calculated in real time by the microcontroller and generated dynamically taking into account external parameters. This allows the realism to be increased.

The display is preferably a display associated with a two-dimensional touch sensor enabling the displacements of at least one finger along at least two different directions to be detected, with the watch comprising a processing circuit specifically arranged for interpreting signals from the touch sensor, for selecting one screen from among several available screens depending on these signals, and for displaying this screen on the entirety of said display. The processing circuit is specifically arranged so as to cause screens to scroll by in order to replace durably the card displayed initially by another screen, with the orientation and the direction of scrolling depending on the orientation and direction of said displacement. Each displayed screen can be associated to an application determining the displayed animated image.

The wristwatch also has the advantage of switching from one screen to an other very simply, through simply horizontal or vertical displacements of the finger on the watch crystal, taking into account the orientation and direction of the finger moving on the screen.

The switching from one screen to another can for example correspond to a change of mode of the watch. For example, the replacement of a simulated mechanical display is effected by the scrolling of screens and by replacing the entire image displayed on the watch by the image of another screen.

BRIEF DESCRIPTION OF THE FIGURES

Examples of embodiments of the invention are indicated in the description illustrated by the attached figures in which.

EXAMPLE(S) OF EMBODIMENTS OF THE INVENTION

Figure 1:
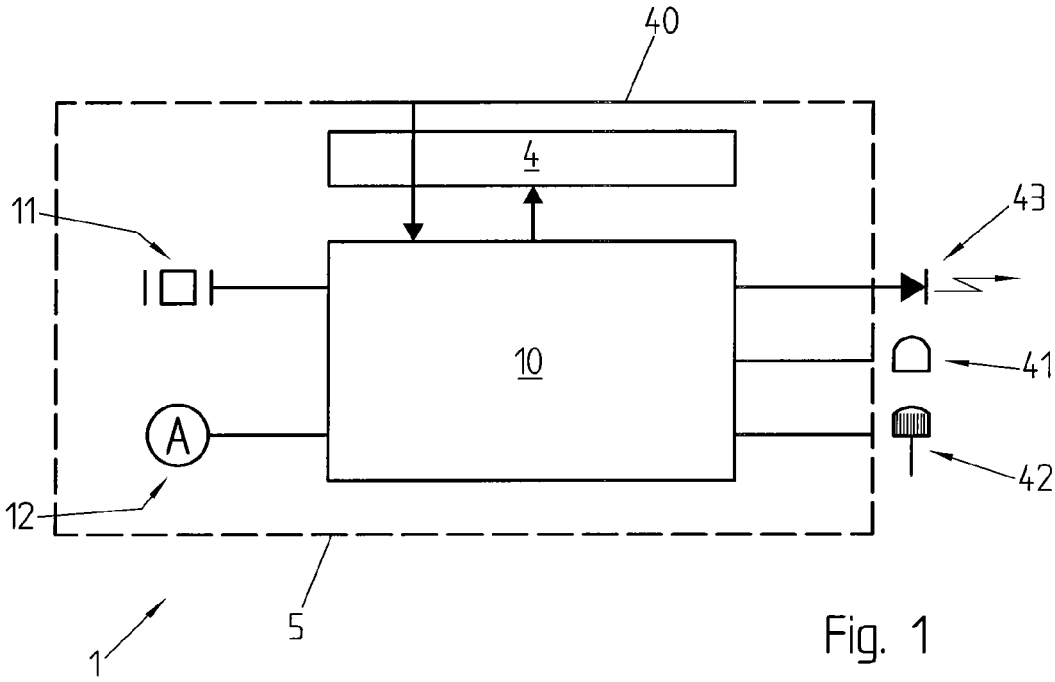
FIG. 1 is a block diagram illustrating schematically different electrical and mechanical components of the watch.

FIG. 1 illustrates schematically different components of a simulated mechanical watch 1 according to the invention. It comprises in this example a watchcase 5 housing a microcontroller 10 displaying indications on a high-resolution digital display 4 that occupies the near entirety of the surface under the watch crystal and thus serves both as watch dial and as time indicator. In a preferred embodiment, the display is constituted by a color liquid crystal matrix display LCD or TFT) with at least 150×150 pixels. Other types of displays, including displays based on OLED technology for example, can be used. Furthermore, the watch could also comprise several displays, for example several digital displays, or a digital matrix display combined with hands or other mechanical indicators.

The microcontroller enables different applications to be executed, on the one hand in order to determine the current time and other chronological indications depending on the output signals of a quartz oscillator 11 in the watchcase or on another time reference signal. On the other hand, the microcontroller executes computer applications stored in a keep-alive memory in order to control the indications displayed on the display 4 according to the time indications and the user's commands or to different sensors. The applications executed by the microcontroller can be updated for example through a wireless interface (not represented) or a micro USB type connector for example, in order to load other code portions for displaying other indications or the same indications in another manner.

The watch can also comprise several microcontrollers, for example a microcontroller for controller the matrix display, another microcontroller for controlling the touch interface and a general microcontroller for determining the indications to be displayed at each instant, according to the selected card. These different microcontrollers can also be grouped together differently.

The display 4 is preferably a display associated with a touch sensor, for example a display associated with a simple-touch or multi-touch touch-sensor. A multi-touch surface is understood in the present application to refer to a touch sensor capable of detecting several simultaneous contact points, for example simultaneous movements of several fingers on the haptic surface. It is surprising to use a multi-touch screen on the reduced surface of a wristwatch, yet against all expectations this technology proves efficient for entering complex commands more quickly than with a single-touch screen. The electrodes of these devices are preferably associated to a circuit or a software that interprets these simultaneous contacts and converts them into commands executed by the microcontroller 10.

Independently of the single-touch or multi-touch aspect, the watch is characterized by the display of a single icon or card at a time, with each card filling the whole screen. The different cards are arranged in a single plane and the selection of a screen is achieved only by horizontal or vertical displacements, in the same plane, without ever switching to another plane. This avoids losing the user in the navigation between several planes of superimposed icons or cards.

The execution of the programs executed by the microcontroller 10 can also be modified by actuating mono-stable push-buttons 41 and/or on the axial and/or angular position of a crown 42 (as an option). Reference number 43 designates additional light indicators, for example light diodes, on the outer surface of the watchcase 5 or of the bracelet. The user interface can also comprise a loudspeaker (not represented) for reproducing sounds generated or stored by the microcontroller, a wireless interface (not represented) of the ZigBee or Bluetooth type for example, a microphone, etc.

The watch can also include a loudspeaker that can be used for reproducing sounds. In one embodiment, the sounds generated and reproduced depend on the displayed simulation, for example in order to reproduce a "tic tock" synchronized with the oscillations of the simulated regulating organ.

The electric supply of the watch is advantageously achieved by means of an accumulator rechargeable through a micro or nano USB connector, of a specific or proprietary connector or, in one embodiment, through a radio-frequency interface.

The inventive wristwatch further advantageously comprises an accelerometer 12 capable of measuring the acceleration to which the watch is subjected and of supplying to the microcontroller 10 a signal according to this acceleration. The accelerometer is preferably a 3D accelerometer capable of measuring the acceleration in three dimensions and of determining the vertical direction during periods of motionlessness. This acceleration is for example useful for controlling and turning the display depending on the orientation of the watch and for simulating the effect of the acceleration on the parts represented on the screen, notably the deformation of the spiral, as will be seen further below. It is also possible to use an accelerometer combined with a gyroscope for measuring the angular acceleration along one or several axes and for simulating the effect of rotations on the displayed representation.

FIGS. 2 to 5 illustrate different examples of displays on a wristwatch 1 according to the invention. The illustrated watch comprises notably a bracelet 2 and a watchcase 5 provided with a watch crystal 3 covering a digital matrix display 4. It integrates for example the circuit of FIG. 1.

Figure 2:
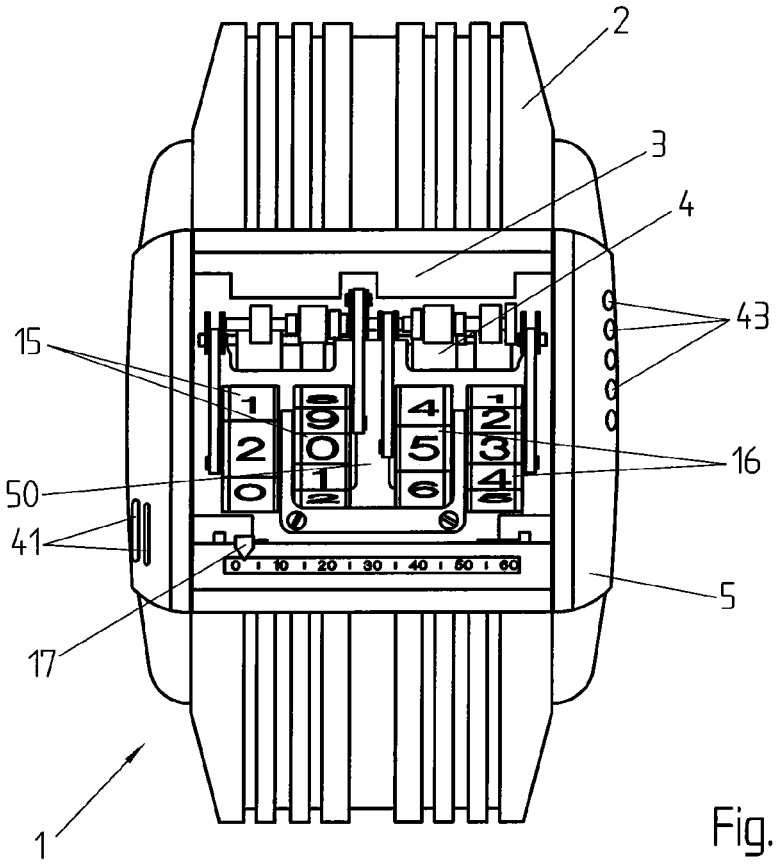
FIG. 2 illustrates an example of a watch with a first example of display on the dial.
Figure 3:
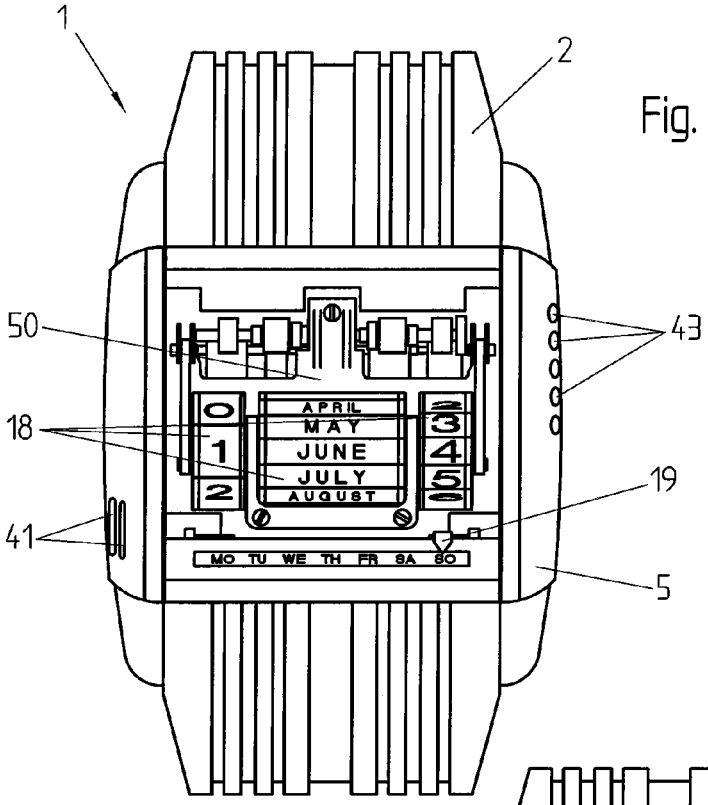
FIG. 3 illustrates a watch with a second example of display on the dial.
Figure 5:
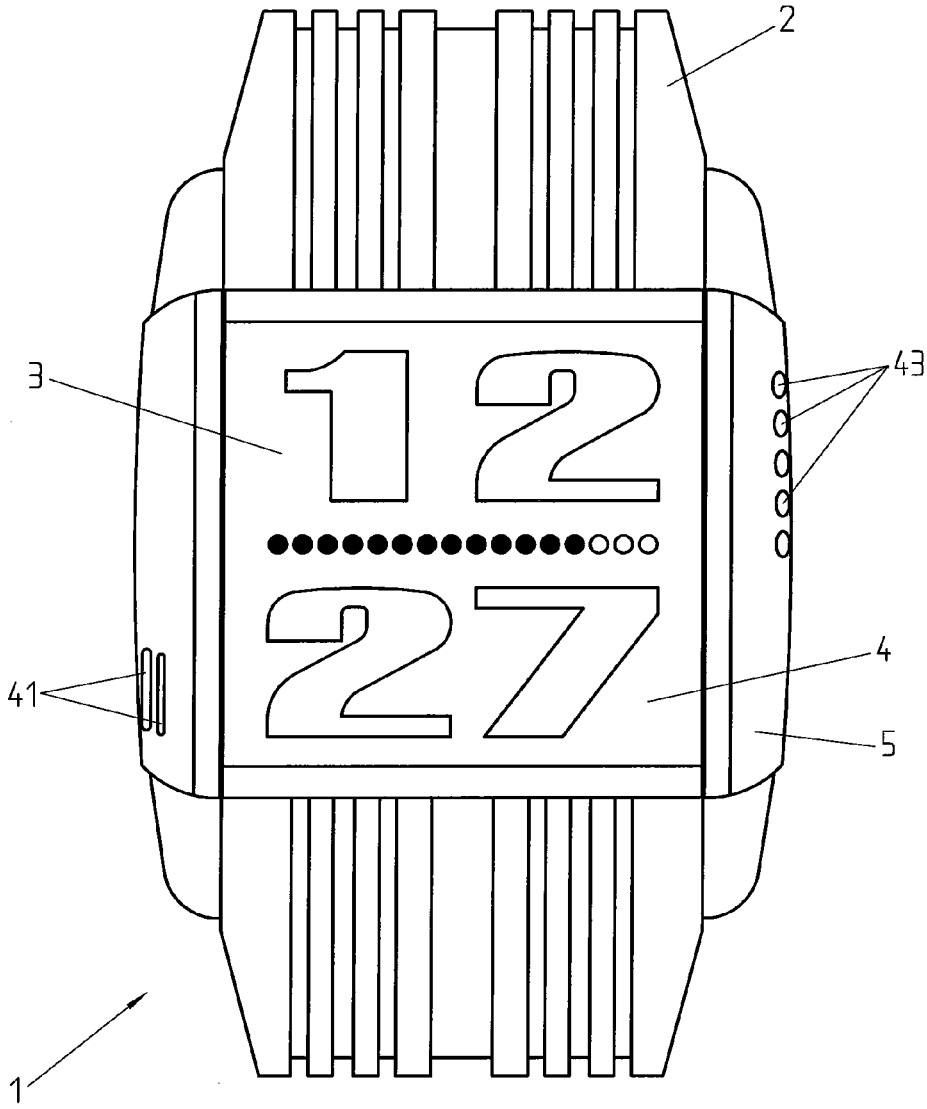
FIG. 5 illustrates a watch with a fourth example of display on the dial.

The watchcase 5 can comprise control elements, for example push-buttons 41, a crown 42 etc. that are however not indispensable for operation; in FIGS. 2, 3 and 5, the watch is crownless and has only push-buttons 41 for switching the screen on or off, for adjusting its brightness or for controlling applications. It is also possible in one option to make a watch without push-button and/or wherein the screen is switched on or off through the touch screen, for example by a long pressure on a predetermined zone of the touch screen. Optionally, a brightness sensor, not represented, enables the intensity of the screen to be adapted automatically to the ambient luminosity. This sensor can also be used for adapting the intensity and direction of the shadows that are simulated and drawn on the display depending on the intensity and direction of ambient light.

The watch crystal 3 closes off the upper surface of the watchcase and covers the digital matrix display 4. It is preferably made of sapphire or of another scratchproof material and is coated with an anti-glare treatment. In a preferred embodiment, the crystal is cylindrical domed or possibly spherical domed.

Transparent electrodes (not represented) are placed in or under the crystal 3 in order to detect the presence of a finger or of a stylus. Detection technology preferably uses methods known in the state of the art, for example a capacitive detection.

The microcontroller 10 makes it possible to interpret the signals coming from the electrodes and to display on the matrix display 4 indications depending on these signals.

Figure 4:
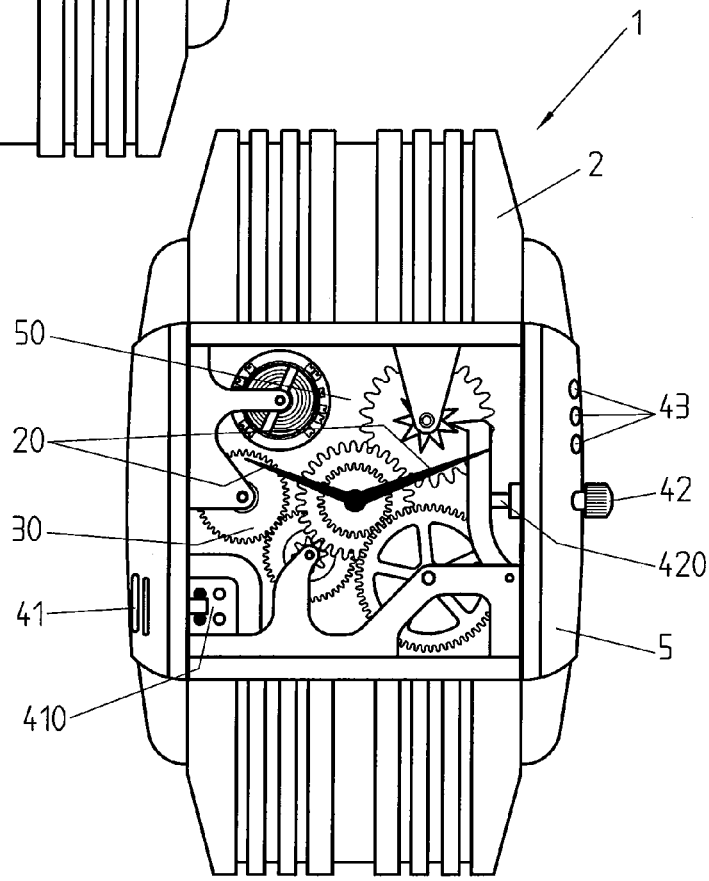
FIG. 4 illustrates a watch with a third example of display on the dial.

The user can switch from one display mode to another and for example replace the display of FIG. 2 by that of one of the FIG. 3, 4 or 5, or by another display, by simply scrolling the displays on the screen by moving the finger on the screen in the desired scrolling direction.

FIG. 2 illustrates a display mode in which the time is displayed by means of a virtual mechanical movement simulated and displayed on the screen 4. In this example, the hours, respectively the minutes, are displayed by means of simulated jumping cylinders 15, 16 indexed in near-instantaneous manner at each hour or minute change. The seconds are displayed by means of a simulated linear and retrograde seconds' hand 17 moving at 6 o'clock at the bottom of the screen. The movement illustrated here is of the skeleton type and shows part of the wheelwork and other movement components. In this example, most of the wheels and pinions are arranged around horizontal axes (parallel to the dial).

The wristwatch thus displays the simulated movement and the indicators 15, 16, 17 over the entire surface of the electronic display, so that it occupies the position and the dimensions of a real mechanical movement in a skeleton watch for example. The user thus has the feeling of wearing a real mechanical watch. In order to reinforce the realism and the impression of three-dimensional depth, the microcontroller 10 can display shadows on the elements of the simulated movement; the intensity and the direction of the shadows can also depend on the measurements of the ambient light taken by one or several light sensors.

The user can replace one displayed simulated movement by another available movement. FIG. 3 illustrates the display of a movement enabling the date, respectively the day of the week, to be displayed by means of jumping cylinders 18 and of a retrograde linear hand 19 respectively. These elements can be represented on the same display 4 instead of the indications in FIG. 2, with the user being able to switch freely from one representation to the other and to replace the display of the first movement by that of the second movement.

FIG. 4 illustrates another time display mode by means of hours' and minutes' hands 20 displayed on the screen 4. In this representation, the hands 20 turn in front of a simulated skeleton movement comprising notably wheelworks 30 and other elements, not represented, for example a regulating organ, a barrel, an oscillating mass or other simulated complications.

The physical crown 42 on the outside of the watch can be actuated to rewind or reset this simulated movement. In one advantageous embodiment, a simulated crown stem 420 is displayed on the screen 4 opposite the crown 42; this stem is controlled by the microprocessor so as to follow the operations of the physical crown 42, giving the user the feeling of really operating this crown stem 420 and the organs connected thereto.

In the same manner, actuating the push-buttons 41 outside the watchcase 5 will advantageously be reflected on the corresponding elements 410 displayed on the screen 4, giving the user the feeling of actuating these elements.

The user can also interact on the elements of the simulated movement through the touch surface 40. For example, in one embodiment, he can move or block the hands 20 or other components by simply moving or pressing the finger on the displayed representation of these components. Advantageously, this displacement causes a change in the running of the movement. For example, if the user moves a hand with the finger, the displayed time is durably modified and the hand starts from the place where the user has left it. In a similar manner, if a user prevents a wheel or a pinion from turning, the simulated movement is stopped for the duration of the blocking operation and the watch is thus delayed. In one embodiment, the user can also temporarily withdraw components of the movement, for example wheelworks, bridges etc., by means of a finger; this makes it possible for example to observe parts in the background that are hidden by others.

In one embodiment, the watch comprises an accelerometer 12 generating an output signal that influences the running of the simulated movement that is displayed. For example, jolts measured by the accelerometer can affect the gear-train that can be represented vibrating in their simulated bearings. If the movement comprises a simulated oscillating mass (not represented), the watch's oscillations can cause an oscillation of this displayed oscillating mass, which can be used for reloading a virtual simulated barrel and rewinding the watch. In the same way, the influence of gravity and other accelerations on the shape of the virtual spiral and on the oscillations of the virtual balance can be simulated and displayed, as well as the displacements of a simulated tourbillon for example.

In one advantageous embodiment, the movement represented is a real simulation of a mechanical movement. The represented simulated components thus have a virtual mass, and the simulated torques or forces are transmitted from one component to another, for example by means of the gear-train. In the same manner, some components, such as the springs, have a virtual rigidity. The microcontroller thus calculates and displays at any time a simulation of the position of each component according to the interactions with the other components, to the acceleration and to interactions of the user on the crown 42, the push-buttons or the crystal for example.

The time displayed at any time thus results form this simulation and can for example be disturbed by accelerations of the simulated regulating organ or by imperfections of the movement. This time can thus differ from the generally more precise time calculated by the microcontroller 10 on the basis of the indications of the quartz oscillator 11. In one embodiment, the time displayed by the simulated and displayed mechanical movement is thus synchronized with the quartz time, either automatically at regular intervals or when the difference exceeds a threshold or manually by the user interacting on one of the push-buttons 41 or on the touch sensor.

It is also possible, in a variant embodiment that is simpler to execute but less realistic, to display a pure image of a movement on the screen, with a position of each component and of the hands that is directly determined according to the time of the quartz 11. Furthermore, the same watch can provide both types of display, for example on two representation modes that can be selected by the user.

The inventive watch can also be used for displaying indications other than the simulated mechanical movements. For example, FIG. 5 illustrates a digital representation mode of the current time on the screen 4. Other indications, for example other virtual digital or hands' displays, calendars, images, photos, text, multimedia pages etc. can be displayed on the display 4.

Figure 6:
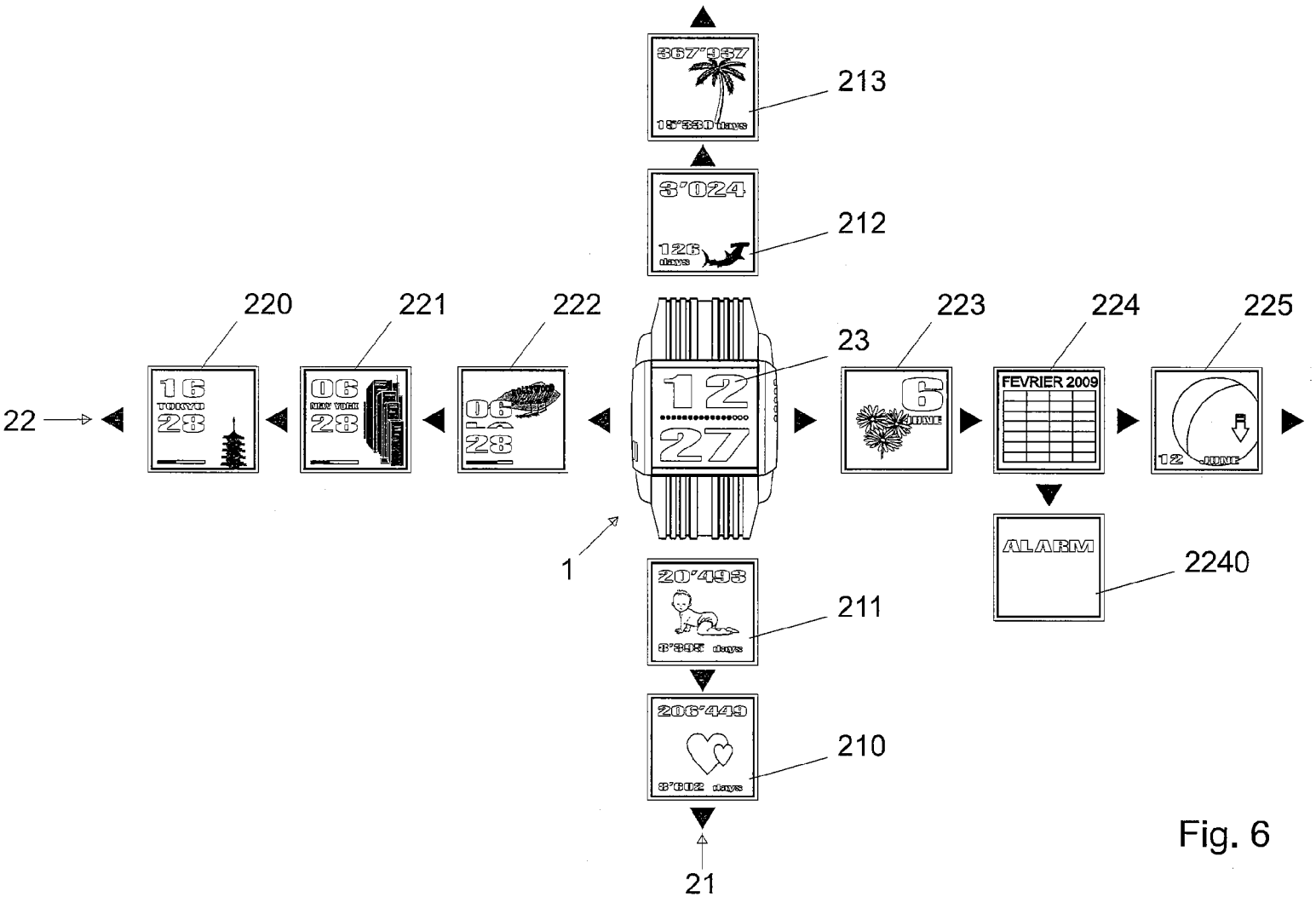
FIG. 6 illustrates schematically the virtual arrangement of different screens in the watch's menu.

FIG. 6 illustrates schematically one possible arrangement of screens enabling different indications or images to be displayed. At least one screen corresponds according to the invention to the display of a simulated mechanical movement.

Other screens can be selected to display other mechanical movements or other indications connected or not to the indication of time.

The size of each selectable screen corresponds to the size of the display 4. The user can modify the current display by replacing permanently, until the next replacement, the displayed screen by any other selected screen.

In this design, the selectable screens are virtually arranged so as to constitute a row 22 and a virtual column 21. The user can make the screens scroll in the horizontal direction in order to replace the current screen 23 by any other screen 220 to 225 of the row 22. Similarly, the user can scroll the screens vertically in order to select one of the screens 210 to 213 of the column 21. All the information available can thus be displayed by simply scrolling horizontally or vertically.

The scrolling of screens in the horizontal or vertical direction is achieved by moving the finger on the watch crystal in the corresponding direction and orientation. The user can thus easily consult the available screens and chose a particular screen with simple finger movements in the horizontal or vertical direction.

Advantageously, the user can add screens, delete screens, modify the order of the screens in the row and in the column etc. from a particular menu of the watch or from a personal computer connected to the watch. A user can thus update a mechanical movement or add an additional representation of a mechanical movement into an existing watch.

Each screen can be associated with a computer program or module for calculating the displayed data, and with data used by this module, for example in order to calculate and display the position of each of the components of a simulated virtual mechanical movement. For example, different screens corresponding to different mechanical movements can be associated to different computer programs enabling these movements to be simulated and the corresponding simulations to be displayed.

As indicated, each screen can display a different indication or correspond to a particular operating mode of the watch. For example, the screens 220, 221 and 222 are used for displaying the current time in the time zones of Tokyo, New York and Los Angeles. The screens 210, 211, 212 and 213 make it possible to display the number of days, respectively of hours, since a given instant, for example since birth, a wedding, the last cigarette etc. Other cards or screens can be used for displaying the phases of the moon, a calendar or further indications of time or other.

| Reference numbers used in the figures | |
|---|---|
| 1 | Wristwatch |
| 2 | Bracelet |
| 3 | Watch crystal (glass) |
| 4 | Matrix display |
| 40 | Touch sensor or surface |
| 41 | Push-button |
| 410 | Simulated element actuated by the push-button |
| 42 | Crown |
| 420 | Simulated crown stem |
| 43 | Light indicator |
| 5 | Watchcase |
| 10 | Microcontroller |
| 11 | Quartz oscillator |
| 12 | Accelerometer |
| 15 | Hour display cylinder |
| 16 | Minute display cylinder |
| 17 | Retrograde linear seconds' hand |
| 18 | Cylinders for displaying the day and month |
| 19 | Retrograde linear hand for the day of the week |

-continued

| Reference numbers used in the figures | |
|---|---|
| 20 | Moving hours' and minutes' hands |
| 21 | Column of cards |
| 22 | Row of cards |
| 23 | Starting card |
| 220-222 | Card for displaying the time in three different time zones |
| 210-213 | Cards for displaying the number of days or hours since a given event |
| 223 | Card for displaying the current date |
| 224 | Card for displaying a calendar |
| 2240 | Card for adding an alarm into the calendar |
| 225 | Card for displaying the moon phase |
| 30 | Wheelwork |
| 50 | Virtual and/or simulated mechanical movement |

The invention claimed is:

1. Wristwatch comprising:

a watchcase;

an electronic display in said watchcase;

a quartz oscillator, a microcontroller being arranged for reproducing on said electronic display the simulation of a mechanical watch movement comprising a gear train, said simulation being visible so as to indicate the time, said microcontroller being further arranged for synchronizing the displayed time by said displayed mechanical movement with that of said quartz oscillator.

2. The wristwatch of claim 1, wherein:

said electronic display is associated with a touch sensor;

and the position of at least one component of said movement can be modified by pressing on the position of said electronic display corresponding to said component.

3. The wristwatch of claim 2, wherein said microcontroller is arranged for displaying the simulation of a movement and wherein the angular position of at least one element of said gear-train can be modified by pressing on said touch sensor.

4. The wristwatch of claim 1, comprising a crown outside said watchcase;

a crown stem being displayed on said display opposite said crown, the position of said displayed crown stem being modified by said microcontroller when said microcontroller detects that said crown has been actuated, so as to simulate a direct action by said crown on said displayed crown stem.

5. The wristwatch of claim 1, comprising a push-button outside said watchcase;

an element displayed on said display opposite said push-button, the position of said element being modifiable by said microcontroller when said microcontroller detects that said push-button has been actuated, so as to simulate a direct action by said push-button on said displayed element.

6. The wristwatch of claim 1, further comprising an accelerometer, said microcontroller being arranged for modifying the position of at least one of said elements of said movement according to the data from said accelerometer.

7. The wristwatch of claim 6, wherein said displayed mechanical movement is an automatic movement with an oscillating mass, the position of said displayed oscillating mass depending on an output signal from said accelerometer.

8. The wristwatch of claim 6, wherein said displayed mechanical movement comprises a regulating organ with a balance and/or a tourbillon displayed on said display, the position of said displayed balance and/or tourbillon depending on an output signal from said accelerometer.

9. The wristwatch of claim 1, wherein said displayed mechanical movement comprises a regulating organ with a balance, a returning element and an escapement, the microcontroller being arranged for calculating and displaying a simulation of the oscillations of said displayed regulating organ taking into account the mass of said balance and the rigidity of said returning element, wherein the displayed time depends on said simulation.

10. The wristwatch of claim 9, comprising means for modifying the running of said displayed regulating organ according to the accelerations to which the watch is subjected.

11. The wristwatch of claim 1, arranged for performing said synchronization periodically in an automatic manner.

12. The wristwatch of claim 11, comprising means for entering and executing a request for said synchronization by the user.

13. The wristwatch of claim 1, arranged for displaying said mechanical movement on the whole surface of the electronic display so as to occupy the position and the dimensions of a real mechanical movement.

14. The wristwatch of claim 1, said microcontroller being arranged for enabling different mechanical movements selectable by the user for display.

15. The wristwatch of claim 1, said display being a display associated with a touch sensor enabling the displacements of at least one finger along at least two different directions to be detected, with the microcontroller being specifically arranged for interpreting signals from the touch sensor, for selecting one screen from among several available screens depending on these signals, and for displaying this screen on the entirety of said display, said microcontroller being further specifically arranged so as to cause screens to scroll by in order to replace durably the screen displayed initially by another screen, with the orientation and the direction of scrolling depending on the orientation and direction of said displacement, wherein at least two of said screens correspond to two distinct mechanical movements that can be selected by the user.

16. Wristwatch comprising:

a watchcase;

an electronic display in said watchcase;

a touch sensor associated with said display and enabling the displacement of at least one finger along at least two different directions to be detected a quartz oscillator, a microcontroller being arranged for reproducing on said electronic display a simulation of a mechanical watch movement comprising a gear train visible so as to indicate the time and for synchronizing the displayed time by said displayed mechanical movement with that of said quartz oscillator, said microcontroller being further arranged for interpreting signals from the touch sensor, for selecting one screen from among several available screens depending on these signals, and for displaying this screen on the entirety of said display, said microcontroller being further specifically arranged so as to cause screens to scroll by in order to replace durably the screen displayed initially by another screen, with the orientation and the direction of scrolling depending on the orientation and direction of said displacement, wherein at least two of said screens correspond to two distinct mechanical movements that can be selected by the user.

17. Method for displaying time in a wristwatch, comprising displaying on an electronic display of a simulated mechanical watch movement comprising a gear train and of time indicators so as to simulate a mechanical watch, said method comprising a step of modifying a position of at least one component of said mechanical movement by detecting displacement of a finger on that component with a touch sensor connected to said display.

18. The method of claim 17, wherein:

the angular position of at least one element of the gear train displayed on said display is modified by pressing on said element, a crown stem is displayed on said display opposite a crown on the outside of a case of the watch, the displayed position of said crown stem being modified when an actuation of said crown is detected, so as to simulate a direct action by said crown on said displayed crown stem;

an element is displayed on said display opposite a push-button on the outside of the watchcase, the position of said element being modifiable by said microcontroller when said microcontroller detects that said push-button has been actuated, so as to simulate a direct action by said push-button on said displayed element;

the position of at least one element of said movement is modified according to the data from an accelerometer;

the position of an oscillating mass displayed on the display depends on an output signal from said accelerometer;

the position of a balance and/or tourbillon displayed on said display depends on an output signal from said accelerometer;

the oscillations of a regulating organ displayed on said display are simulated taking into account the simulated mass of a simulated balance and the rigidity of a returning element displayed on said display, with the time displayed being dependent on said simulation;

the running of said displayed regulating element is modified according to the accelerations to which the watch is subjected;

the running of a quartz oscillator is synchronized periodically or upon request from the user with the time displayed by said mechanical movement;

said displayed mechanical movement is displayed on the entire surface of the electronic display so as to occupy the position and the dimensions of a real mechanical movement;

the user selects the mechanical movement displayed on said display from among several available mechanical movements to be chosen from.

19. The method of claim 17, comprising a step of loading new displayable mechanical movements through an input-output interface of the watch.

* * * * *